US006898803B1

(12) United States Patent
Blauer et al.

(10) Patent No.: US 6,898,803 B1
(45) Date of Patent: May 31, 2005

(54) CRUMPLE RESISTANT LINING AND OUTERWEAR FOR USE THEREWITH

(75) Inventors: Stephen J. Blauer, Lexington, MA (US); Toufic G. Atallah, Reading, MA (US)

(73) Assignee: Blauer Manufacturing Co. Inc., Boston, MA (US)

( * ) Notice: Subject to any disclaimer, the term of this patent is extended or adjusted under 35 U.S.C. 154(b) by 204 days.

(21) Appl. No.: 10/160,847

(22) Filed: May 31, 2002

Related U.S. Application Data

(63) Continuation-in-part of application No. 10/040,563, filed on Jan. 6, 2002, now Pat. No. 6,490,734, which is a continuation-in-part of application No. 09/707,098, filed on Nov. 6, 2000, now Pat. No. 6,336,221.

(51) Int. Cl.[7] ..... A41D 1/00
(52) U.S. Cl. ..... 2/97
(58) Field of Search ..... 2/69, 81, 93, 97, 2/59, 268, 272, 87

(56) References Cited

U.S. PATENT DOCUMENTS

| | | | | | |
|---|---|---|---|---|---|
| 2,990,550 | A | * | 7/1961 | Locketz | 2/97 |
| 5,469,581 | A | * | 11/1995 | Uthoff | 2/69 |
| 6,247,179 | B1 | * | 6/2001 | Underwood et al. | 2/81 |
| 6,427,242 | B1 | * | 8/2002 | Bush et al. | 2/69 |

* cited by examiner

*Primary Examiner*—Gary L. Welch
(74) *Attorney, Agent, or Firm*—Altman & Martin

(57) ABSTRACT

A detachable lining for outerwear comprises a bodice, which includes an inner substantially full layer composed of a relatively rough fabric, an outer substantially full layer composed of a relatively smooth fabric, and an overlay partial layer composed of a relatively smooth fabric. The partial layer is superposed on the inner layer at an upper region of the bodice. The inner layer and outer layer are quilted together for enhancing dimensional stability and preventing bunching. The overlay partial layer has a relatively low coefficient of friction for encouraging sliding and preventing catching.

2 Claims, 6 Drawing Sheets

CRUMPLE RESISTANT LINING AND OUTERWEAR FOR USE THEREWITH

RELATED APPLICATION

The present application is a continuation-in-part of application Ser. No. 10/040,563, filed Jan. 6, 2002, now U.S. Pat. No. 6,490,734 which in turn is a continuation-in-part of application Ser. No. 09/707,098, filed 6 Nov. 2000, now U.S. Pat. No. 6,336,221.

GOVERNMENT FUNDING

Not Applicable

BACKGROUND OF THE INVENTION

1. Field of the Invention

The present invention relates to clothing and, more particularly, to linings for jackets, coats and the like, for example, removable linings for waterproof and windproof jackets of the type used in inclement environments by personnel involved in law enforcement, emergency medicine, fire and safety service, general work service, and the like.

2. The Prior Art

Since linings generally are designed for warmth, they often incorporate a fleece or other fleece-like fabric, which both (1) comfortably drapes about contours of the body, and (2) snugly clings incrementally to the body and to surfaces of clothing being worn on the body. From a scientific standpoint, draping may trap warm air between the body and the lining, and clinging may present an insulating stratum of relatively low heat transmissivity in contiguity with the body. Conventional linings composed of such a fleece-like fabric, however, often tend to crumple, i.e. to bunch and/or catch, inconveniently when being fitted into a jacket before wearing, as well as when the jacket and lining assemblage is being put on or taken off by a wearer. In effect: bunching may occur because the fleece-like fabric tends to have a critically low dimensional stability; and catching may occur because the fleece-like fabric tends to have a critically high coefficient of friction.

SUMMARY OF THE INVENTION

The primary object of the present invention is to provide a lining for outerwear having a combination of: strategic regions of high dimensional stability; and strategic regions of low coefficient of friction. This combination enhances the convenience of assembling a removable lining into the outerwear, and eases putting on and taking off the outerwear when assembled with the lining.

Pursuant to the present invention more specifically, the lining comprises particular relationships among the fabric strata of the bodice and the sleeves of the lining. The bodice includes a front fleece-like fabric, a back low-friction fabric, and an intermediate filler there between. A low friction fabric overlay, is strategically superposed on an upper region of the bodice, and spans the bodice substantially from sleeve to sleeve. Quilting the front, intermediate, and back layers permits conformation with the contours of the body, yet establishes sufficient dimensional stability to inhibit bunching. The low friction overlay is strategically positioned where most of the mechanical stress occurs to inhibit catching of the lining on contiguous sections of the body and/or clothing that it contacts when the jacket or the like is put on or taken off by a wearer.

A further object of the present invention is to incorporate the aforementioned lining into inclement-environment-resistant outerwear, particularly waterproof, windproof and breathable jackets. Such jackets often have incorporated combinations and sequences of different layers, such as a micro-porous membrane layer for vapor permeability, and/or a hydrophobic layer for truly effective waterproofing and wind proofing. The lining of the present invention is particularly useful in connection with such jackets, when expedition is imperative.

Other objects of the present invention will in part be obvious and will in part appear hereinafter.

BRIEF DESCRIPTION OF THE DRAWINGS

For a fuller understanding of the nature and object of the present invention, reference is made to the accompanying drawings, wherein.

DETAILED DESCRIPTION OF THE PREFERRED EMBODIMENT

Figure 1:
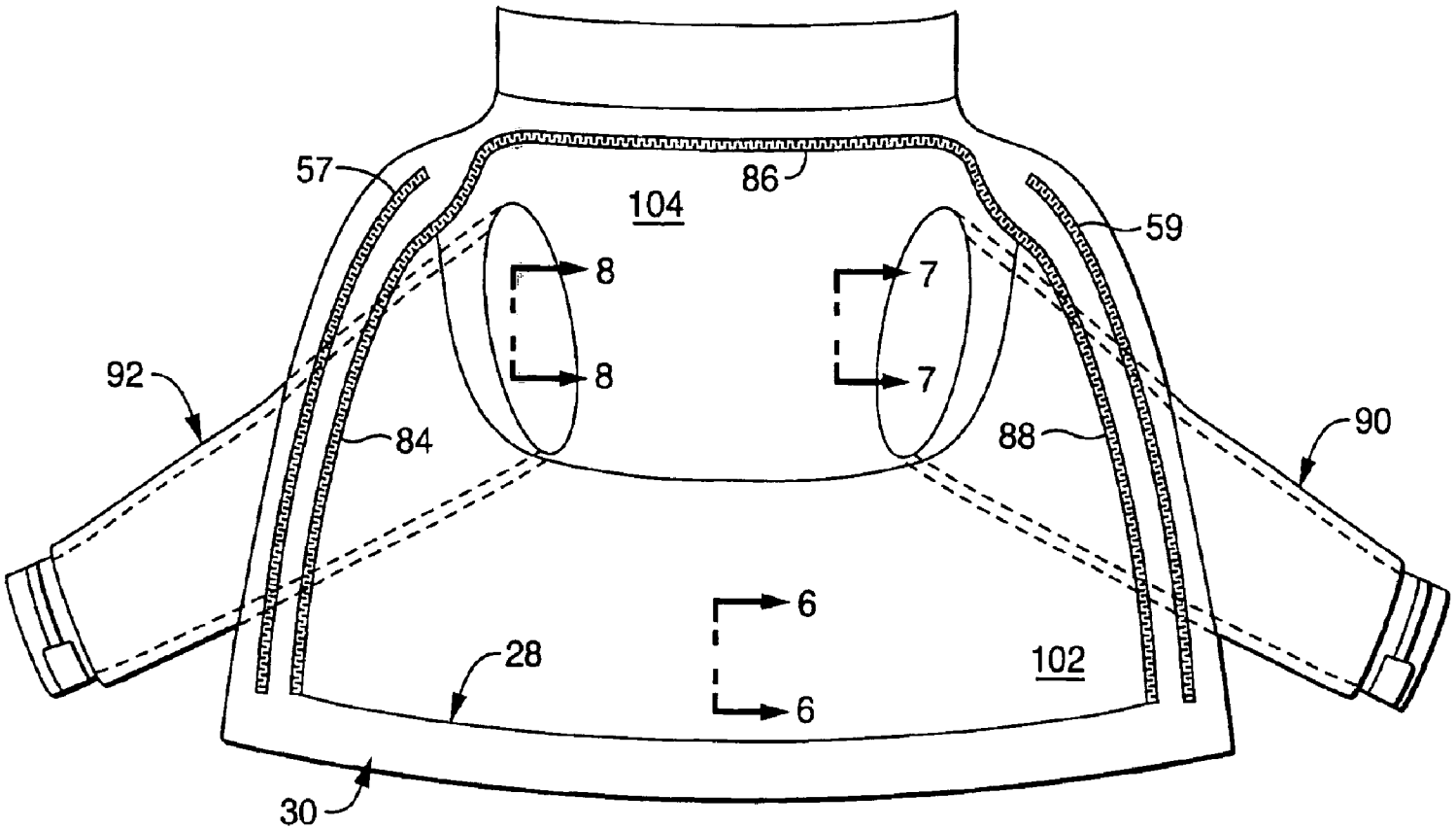
FIG. 1 is a front view of the interior of an unfastened, open jacket and lining, which incorporate features of the present invention.
Figure 2:
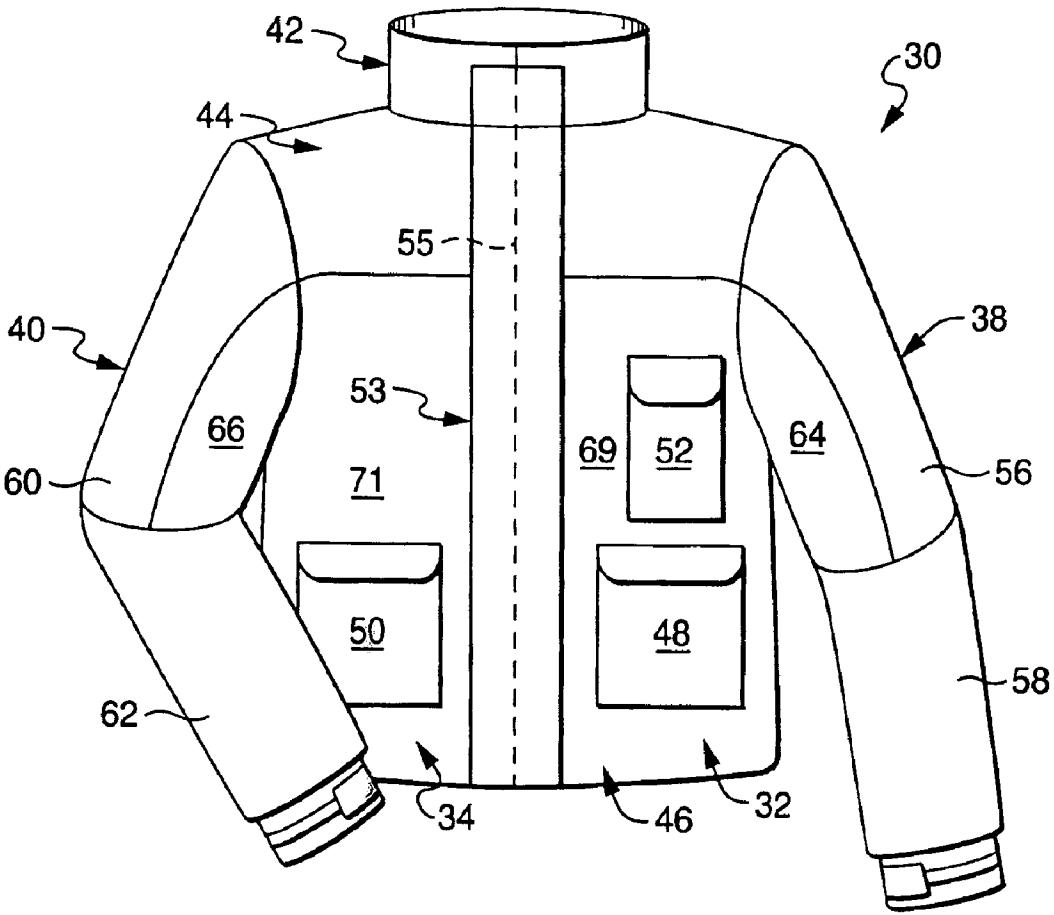
FIG. 2 is a front view of a fastened jacket of conventional appearance, incorporating a removable lining in accordance with the present invention.
Figure 3:
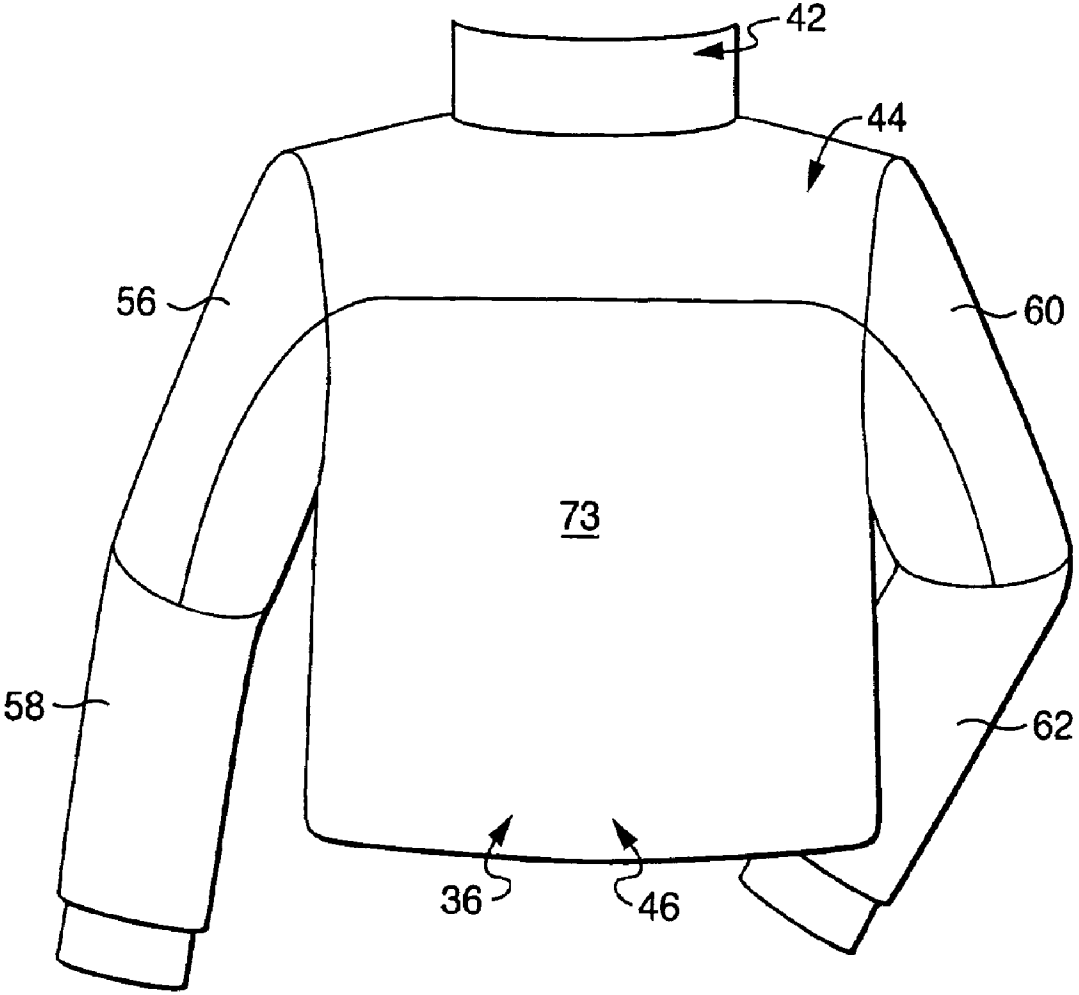
FIG. 3 is a back view of the jacket of FIG. 2.

FIGS. 1, 2 and 3 illustrate a preferred embodiment of the present invention as including a lining 28 and a jacket shell 30, which incorporate the present invention.

The Jacket Shell of FIGS. 1–3

Shell 30, as shown in FIGS. 2 and 3, includes left and right body sections 32, 34, a back body section 36, a pair of sleeves 38, 40, a collar section 42, a yoke section 44 that extends across a wearers shoulders from sleeve to sleeve and about collar section 42, and a waist section 46 that encompasses a wearers torso at the lower edges of the left, right and back body sections. Body sections 32, 34, 36 extend between yoke section 44 and waist section 46. Front body sections 32, 34 have lower left and right patch pockets 48, 50, and an upper patch pocket 52. A center fly 53 hides a zipper 55, which extends from collar section 42 to waist section 46. As shown in FIG. 1, a pair of opposed lengths of zipper 57, 59 serve to fasten and unfasten the front of the jacket.

Sleeve 38 is formed from an upper section 56 and a lower section 58. Upper section 56 extends from the upper arm downwardly from yoke section 44 to lower section 58. Lower section 58 envelops and lower arm and wrist. Similarly, sleeve 40 is formed from an upper section 60 and a lower section 62. Upper section 60 extends downwardly from yoke section 44 to lower section 62. Lower section 62 envelops the lower arm and wrist. Inner arm sections 64 and 66 are composed of the same materials as are the lower sections 69, 71 and 73 of the bodice.

In one preferred embodiment, the jacket is composed of a waterproof, windproof, breathable laminate of the type sold under the trade designation CROSSTECH by W. L. Gore and Associates, Inc., of Elkton, Md., USA. In one form, this laminate comprises an outer facing fabric layer, a medial membrane layer, and an inner backing fabric layer. In an alternative embodiment, the jacket is composed of a waterproof, windproof, breathable laminate, which is sold under the trade designation GORETEX by W. L. Gore and Associates, Inc., of Elkton, Md., USA. This laminate comprises facing, medial and backing layers, of the type mentioned above, except that the oleophobic polymer is omitted from the medial layer. In still another alternative embodiment, the jacket is composed of an alternative waterproof, windproof, breathable laminate that comprises an outer facing fabric layer, a medial membrane layer, and an inner backing or liner fabric layer. The facing and backing layers are analogous to their counterparts as described above. However, the medial fabric layer is a film composed of a monolithic, hydrophilic polyurethane of a type sold under the trade designation XALT by Burlington Industries, Inc., Greensboro, N.C., USA.

The Lining of FIGS. 4–8

The lining, as illustrated at 28 in FIGS. 4 to 8, comprises: a bodice 78 that extends downwardly from a collar region 80 to a waist region 82; a continuous zipper 84, 86, 88 (or other extended fastener or line of fasteners) that detachably connects the border regions of bodice 78 to border regions at the sides and collar of the shell; and sleeves 90,92 that are insertable into and removable from the corresponding sleeves of the shell.

Figure 6:
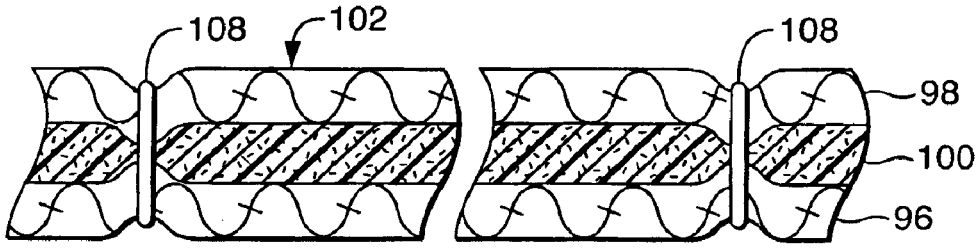
FIG. 6 is a cross-sectional view, greatly exaggerated, of a mid-section of the bodice of the lining of FIGS. 4 and 5, taken along the line 6—6 of FIG. 1.
Figure 7:
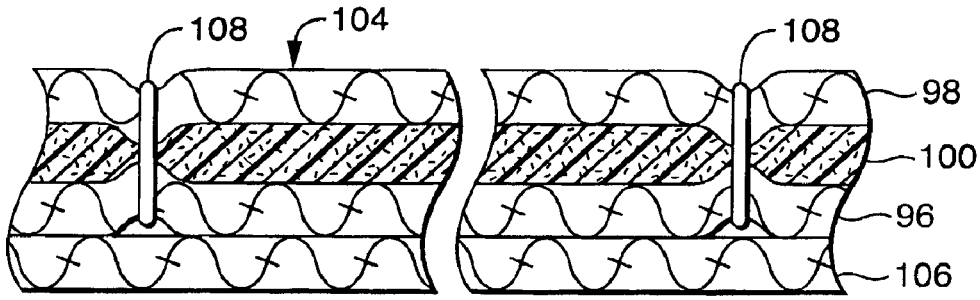
FIG. 7 is a cross-sectional view, greatly exaggerated, of an upper section of the bodice of the lining of FIGS. 4 and 5, taken along the line 7—7 of FIG. 1.

As indicated earlier, bodice 78 and sleeves 90,92 of the lining are characterized by a combination of strategically located high dimensional stability and strategically located low coefficient of friction. As shown in FIGS. 1 and 6, the lower region 102 of bodice 78 includes an inner or front fleece-like fabric 96, an outer or back low-friction fabric 98, and an intermediate filler 100 there between. As shown in FIGS. 1 and 7, the upper region 104 of the bodice includes, as in the lower region 102 discussed above, inner or front front fleece-like fabric 96, outer or back low-friction fabric 98, intermediate filler 100 there between, and, additionally, a low friction fabric overlay 106, which is superposed on the bodice and which spans the bodice from sleeve to sleeve.

Figure 4:
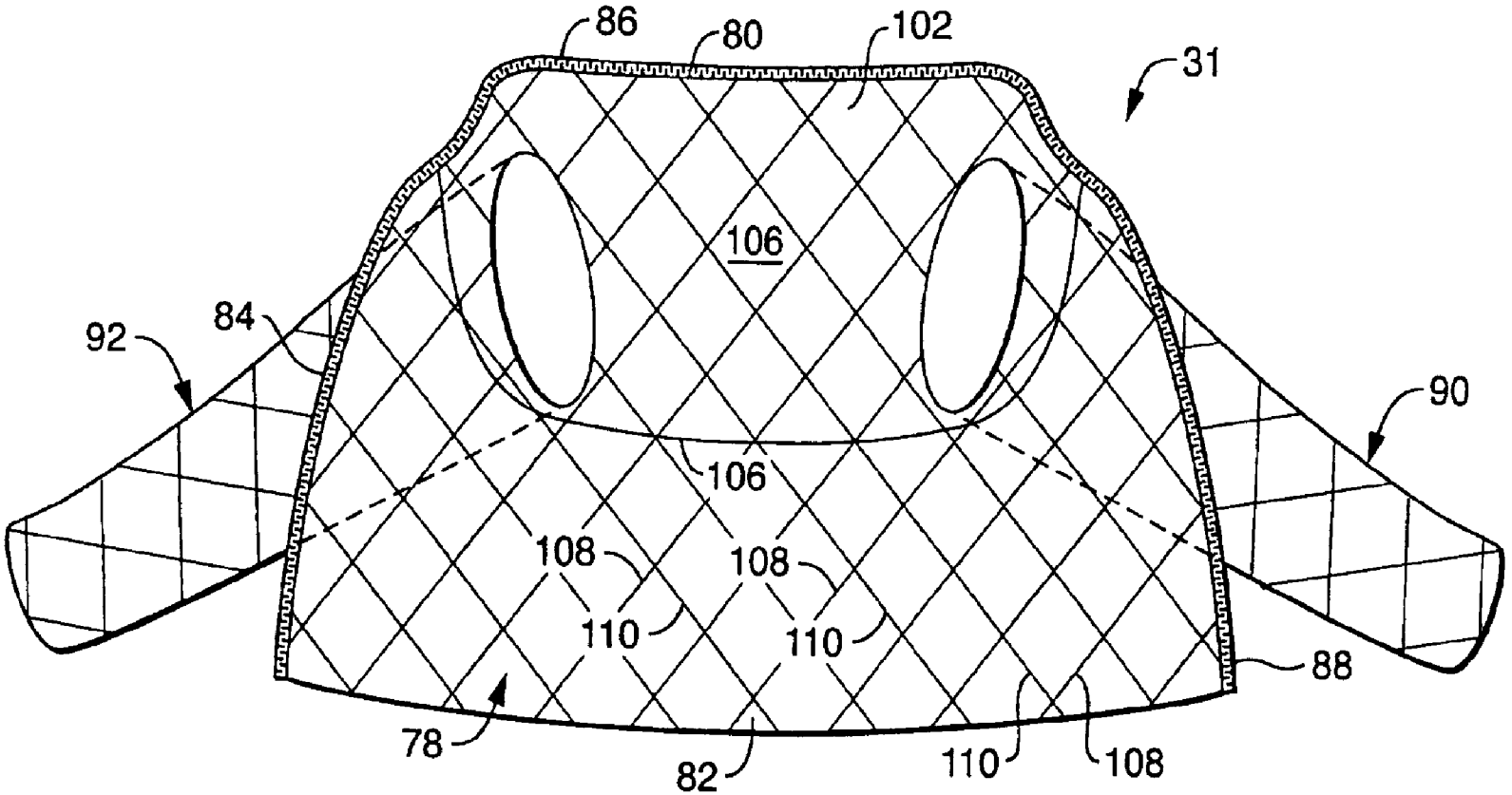
FIG. 4 is a front view of the lining as shown in FIG. 1, illustrating details of its construction.

As shown in FIGS. 4,6 and 7, front, intermediate and back fabric layers 96, 98 and 100 are quilted, i.e. are joined by staggered intersecting lines of stitching 108, 110, which divide the bodice into geometrical sections that provide greater dimensional stability than would be the case without quilting. This quilting permits conformation with the contours of the body, yet inhibits bunching. The strategic position of low friction overlay 106 inhibits catching of the lining on contiguous sections of clothing that are contacted when the jacket or the like is put on or taken off by a wearer.

Figure 5:
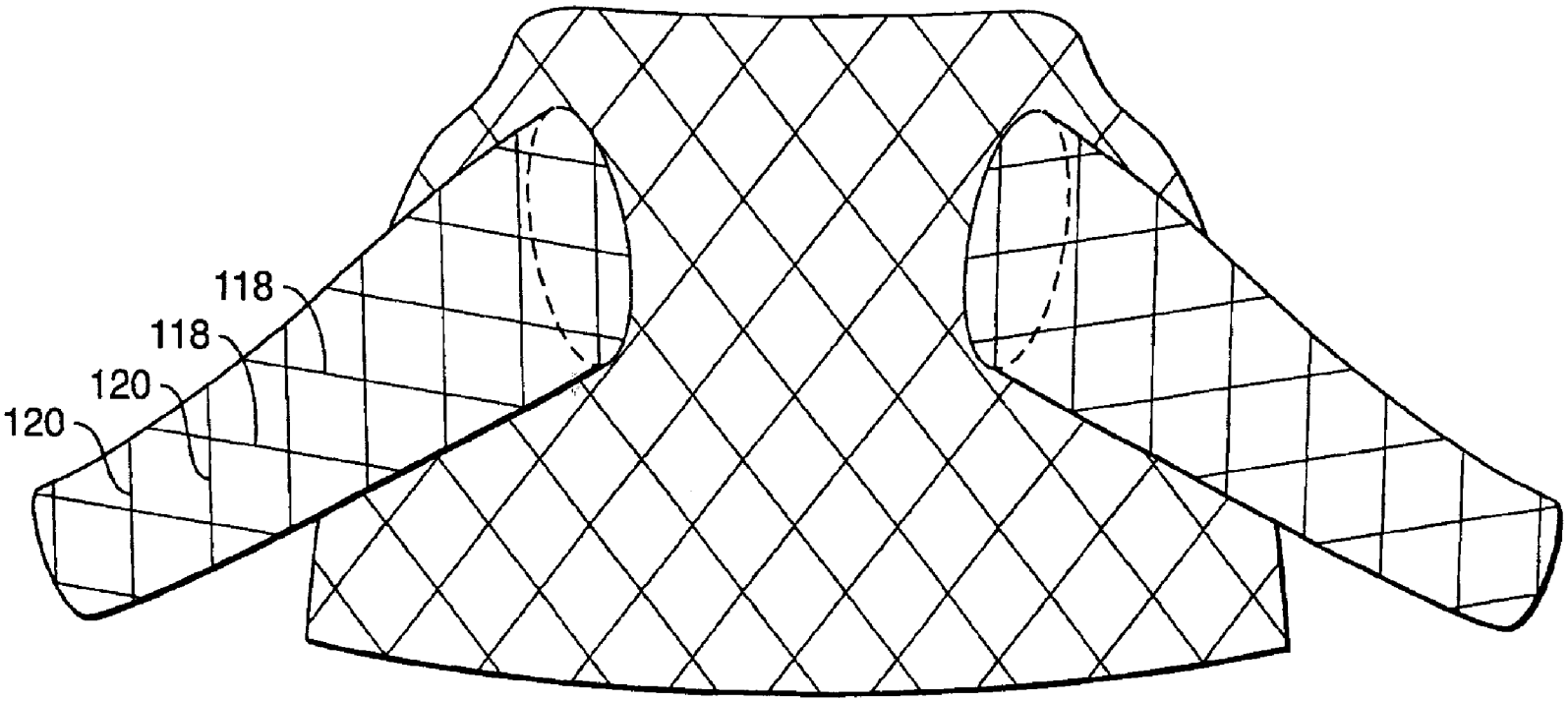
FIG. 5 is a back view of the lining as shown in FIG. 4, illustrating details of its construction.
Figure 8:
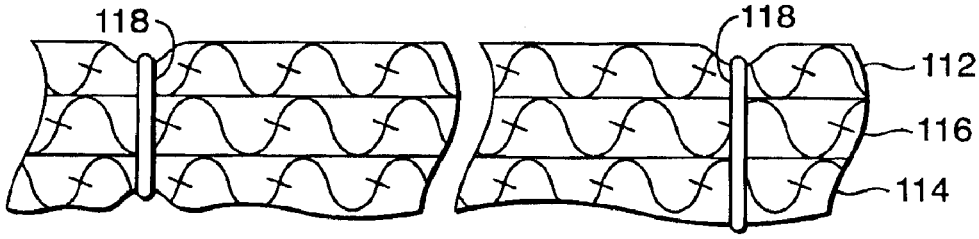
FIG. 8 is a cross-sectional view, greatly exaggerated, of a section of a sleeve of the lining of FIGS. 4 and 5, taken along the line –8–8 of FIG. 1.

As shown in FIGS. 5 and 8, each of the sleeves has inner and outer low-friction layers 112, 114, which are separated by intermediate filler layer 116. Here again, the three layers are quilted, i.e. joined by staggered intersecting lines of stitching 118, 120. The quilting provides sufficient dimensional stability to inhibit bunching. The low-frictional surfaces inhibit catching within the sleeves of the jacket.

Preferably, the low-friction fabrics of the bodice and sleeves of the lining, as shown at 98, 112 and 114, are selected from one or a combination of members of the class consisting of taffeta, satin, silk, rayon and cotton sateen. Preferably, the intermediate filler layer is composed of polyester batting or another non-woven fiber, such as that sold by Minnesota Mining and Manufacturing Corporation under the trade designation, THINSULATE.

Operation

The detachable lining of the present invention has a combination of sufficiently high dimensional stability throughout the bodice and sleeves, and sufficiently low coefficient of friction at the upper region of the bodice and at the sleeves to enhance the convenience of assembling the lining into the outerwear, and easing donning and doffing the outerwear when assembled with the lining. A major part of the bodice nevertheless includes a front layer composed of a fleece-like fabric for warmth and comfort.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A detachable lining for outerwear, said lining comprising a bodice and a pair of sleeves said bodice including an inner layer composed of a relatively rough fabric, an outer layer composed of a relatively smooth fabric, an intermediate insulating layer between said inner layer and said outer layer, and a partial layer composed of a relatively smooth fabric;

said inner layer, said outer layer and said intermediate layer extending throughout an upper region and a lower region of said bodice;

said partial layer spanning said bodice from sleeve to sleeve in contact with said inner layer at said upper region only of said bodice;

said inner layer and said outer layer being sewn along intersecting lines to establish quilting;

each of said sleeves including an inner layer of relatively smooth fabric and an outer layer of relatively smooth fabric;

said inner layer and said outer layer of each of said sleeves being sewn together along intersecting lines to establish quilting;

said relatively rough fabric being fleece-like, said relatively smooth fabric including at least one member of the class consisting of taffeta, satin, silk, rayon and cotton sateen, said rough fabric and said smooth fabric have contrasting coefficients of friction, said rough fabric having a relatively high coefficient of friction and said smooth fabric having a relatively low coefficient of friction, dimensional stability of said quilting inhibiting bunching, the low coefficient of friction of said smooth fabric inhibiting catching, combination of strategically high dimensional stability and strategically low coefficient of friction for enhancing the convenience of assembling said lining into said outerwear, and easing donning and doffing of said outerwear when assembled with said lining, said lining comprising a bodice and a pair of sleeves, said bodice including an inner layer composed of a fleece-like fabric, an outer layer composed of a low friction fabric, an intermediate layer composed of an insulating filler between said front layer and said back layer, and an innermost overlay layer superposed on an upper region of said bodice and spanning said bodice from sleeve to sleeve; said inner layer, said intermediate layer, and said outer layer being quilted, said front layer, said intermediate layer, and said back layer permitting conformation with the contours of the body, yet establishing significant dimensional stability to inhibit crumpling.

2. A jacket comprising a shell and a lining:

(A) said shell comprising a shell bodice and a pair of bodice sleeves, said shell bodice having a yoke, a waist, and a collar; said yoke section extending across a wearer's shoulders from arm to arm, and over said wearers shoulders about said collar section; said shell bodice extending between said yoke and said waist; said shell bodice being composed generally of a material that is resistant to inclement conditions;

(B) said lining comprising a lining bodice and a pair of sleeves, said lining bodice having a lining collar region and a waist region, said lining bodice descending from said lining collar region to said lining waist region; a pair of opposed extended fasteners that detachably connect the borders of said lining bodice to interior borders of said shell, said sleeves, when in use, being inserted into and being substantially coextensive said sleeves of said shell; said lining bodice incorporating an outer layer of a relatively smooth fabric, an inner layer of a relatively rough fabric, and an overlay fabric of a relatively smooth fabric, said overlay fabric being superposed only on the upper region of said lining bodice;

(C) said low friction fabric being selected from the class consisting of taffeta, satin, silk, rayon and cotton sateen; said shell being composed of a waterproof, windproof, breathable laminate comprising an outer facing fabric layer, a medial membrane layer, and an inner backing fabric layer; said shell including monolithic, hydrophilic polyurethane; wherein said front and back layers of said shell are quilted; wherein said sleeves of said lining include inner and outer layers of relatively smooth fabric, said last-mentioned inner and outer layers being quilted.

* * * * *